US006342018B1

(12) United States Patent
Mason

(10) Patent No.: US 6,342,018 B1
(45) Date of Patent: Jan. 29, 2002

(54) GOLF CLUB FOR CHIPPING

(76) Inventor: Milton T. Mason, 6 Deerhurst, San Antonio, TX (US) 78218

( * ) Notice: Subject to any disclaimer, the term of this patent is extended or adjusted under 35 U.S.C. 154(b) by 0 days.

(21) Appl. No.: 09/610,324

(22) Filed: Jul. 5, 2000

(51) Int. Cl.[7] ..... A63B 53/00

(52) U.S. Cl. ..... 473/252; 473/252; 473/294; 473/345

(58) Field of Search ..... 473/252, 253, 473/327, 328, 251, 254, 255, 314, 324, 345, 268, 294

(56) References Cited

U.S. PATENT DOCUMENTS

| | | | | |
|---|---|---|---|---|
| D213,326 | S | | 2/1969 | Driscoll |
| D225,419 | S | | 12/1972 | Mills |
| 5,333,873 | A | * | 8/1994 | Burke |
| 5,458,335 | A | | 10/1995 | Hattori |
| 5,533,728 | A | | 7/1996 | Pehoski et al. |
| 5,640,777 | A | * | 6/1997 | Densberger |
| 5,690,556 | A | | 11/1997 | Condon |
| 5,720,668 | A | * | 2/1998 | Brett |
| D394,688 | S | | 5/1998 | Fox |
| 5,746,666 | A | | 5/1998 | Lovett |
| 5,830,082 | A | | 11/1998 | White |
| 5,855,524 | A | * | 1/1999 | Jenkins |
| D405,137 | S | | 2/1999 | Nelson |

FOREIGN PATENT DOCUMENTS

| | | |
|---|---|---|
| GB | 219804 | 8/1924 |
| GB | 1432688 | 4/1976 |
| GB | 608128 | 1/1994 |

* cited by examiner

*Primary Examiner*—Stephen Blau
(74) *Attorney, Agent, or Firm*—Richard C. Litman

(57) ABSTRACT

A golf club for effecting chip shots within sixty yards of play to the "green" is presented. The golf club includes two distinct shaft configurations and has a club head with a striking face or impact surface which gradually narrows downwardly to a rounded bottom edge to form a convex shaped structure. The club is fitted with a long shaft which forces the golfer into an upright position to create a chipping stroke similar to a normal putting stroke. The convex top surface of the golf club head has a series of seven colored parallel grooves incorporated thereon to form an optical pattern to help a golfer's eyes focus and to project a more broad-based target line-up. The angle between the line-up defined by the shaft when positioned normally as during play and a line perpendicular to the ground is six to seven degrees.

7 Claims, 5 Drawing Sheets

GOLF CLUB FOR CHIPPING

BACKGROUND OF THE INVENTION

1. Field of the Invention

The present invention relates generally to golf clubs. More specifically, the invention is an improved golf club for performing chip-shots or hitting a golf ball onto the putting surface or "green" from relatively short distances.

2. Description of the Related Art

The United States has seen unprecedented growth in the popularity of the game of golf in the past decades. Numerous devices have been made to help golfers improve their shots. Putters and chippers of various designs and markings, golf club heads of various angles, and shafts of different lengths and angles of attachment to the golf club head have been introduced. However, despite many attempts, no suitable golf club exists for making chip-shots often less than sixty yards long and approximately four to five feet off the ground. This includes, for example "bump and run" shots. All golfers agree that ninety percent of the game of golf is mental. The other ten percent is primarily physical aptitude including some measure of athleticism.

For the purpose of moving a golf ball from the tee to the green and ultimately into the hole, a golfer is permitted thirteen clubs. Woods (also "metal woods") are available to project the golf ball the greatest distance. The club head is usually quite large by comparison and has very little loft (typically eight to thirteen degrees). Iron headed clubs ("irons") are clubs having varying degrees of loft and various shaft lengths. Because of the various club's loft, irons properly used will propel a golf ball forward to various distances and at varying heights above the ground. Wedges (iron headed clubs with significant loft—up to sixty degrees) are available for short shots into the green. Putters are usually iron headed clubs used to roll a golf ball along the putting surface (green) and into the hole. Putters generally have a ball striking surface (loft) of almost ninety degrees. Providing a golfer with a variety of clubs enables the golfer to take the "same swing" with each club, but get different results in ball flight path and distance. Golf clubs which do not fall within the "same swing" category are wedge and putter clubs.

Using the same swing with a wedge or a putter will result in the same distant and trajectory result. The "finesse" shot (which involves altering the swing speed, back-swing distance, downward club-head speed, and the golfer's body attitude) enables the golfer to propel the golf ball to varying distances. For most golfers, over fifty percent of the shots advanced toward or into the hole are normally within forty yards. Thus, the finesse shot is one of, if not the most important type shot in the game of golf. However, factors such as fright or nervousness, grass height, grass texture, moisture, sand and/or water obstructions contribute to the number of obstacles which serve to raise the level of difficulty for making a finesse shot. It is for these reasons at least the finesse shot is the most difficult shot to master.

Generally, the finesse shot is attempted with the wedge. But this highly lofted short shaft club invites the golfer to impart lateral movement to the club's face by turning the wrist on impact thereby producing an off-line shot. The easiest shot in golf is the putt. This shot is performed with the use of a putter which does not require turning or breaking the wrist of a golfer as with the use of the wedge. As a result, off-line shots are minimized.

The golf club as herein described alleviates the longstanding need for a golf club which integrates the most definitive features of each conventional type of club cited hereinbelow (e.g. wood, iron, wedge and putter) into a singular hybrid club which solves the problems associated with each conventional club and improves the game of golf for golf enthusiasts and professionals within roughly sixty yards of the hole or from the "rough" onto the "green" without the need for extensive practice.

For example, U.S. Pat. No. 5,690,556, issued to Condon, shows a multi-functional golf club head which can be used as either a putter or a chipper, depending on the nature of the terrain on the golf course, having ball centering indicia on the top face, rails on the bottom of the club head, and an angled striking surface. However, this device does not have the optical assisting pattern of the present invention, which is specially designed to maximize a golfer's eye's focus and project a broad-based target line-up to make it easier for the golfer to keep the swing line of the club head on track with the intended path of the ball. U.S. Design Pat. No. 213,326, issued to Driscoll, discloses the ornamental design for golf club head. U.S. Design Pat. No. 225,419, issued to Mills, shows an ornamental design for an golf club. U.S. Design Pat. No. 394,688 also illustrates an ornamental design for a golf club head. And U.S. Design Pat. No. 405,137 shows the ornamental design for a golf putter head.

U.S. Pat. No. 5,458,335, issued to Hattori, reveals a combined putter and wedge golf club having both putting and chipping faces on either side of the club head, which is connected to a shaft rigidly mounted perpendicular to the club, in comparison to the present invention where the angle between the line defined by the shaft, when the putter is in normal play position, and the line perpendicular to the ground is six to seven degrees. And U.S. Pat. No. 5,533,728, issued to Pehoski et al., discloses a golf putter head having a striking surface separated from and parallel to body of the head by a spaced portion.

U.S. Pat. No. 5,746,666, issued to Lovett, shows a golf club having a striking face which angles down narrowly to form a blunt lower apex. The narrow lower apex of this device allows for less contact with the turf during a golf swing, decreasing turf drag to allow shots of at least 170 yards away. Unlike the present invention, which has a broader bottom wall, this club is not specially designed for shots of sixty or fewer yards, neither does it have optical orientation grooves disposed on the top surface of the golf head to assist s golfer in increasing shot accuracy. U.S. Pat. No. 5,830,082, issued to White, shows a golf chipper club construction in which the club head loft is about 30 degrees, while the descent of the sole is approximately 12 degrees. And the angle from horizontal to the grip axis is 80 degrees. The British Patent granted to McKenzie (BR 219,804) shows a golf club having a streamlined head with a curved taper. The British Patent granted to Miyamoto (BR 1,432,682) provides a club with a rotatable moveable head having a plurality of faces for hitting at different angles. And the European Patent granted to Schmidt (EP 608,128) discloses a golf putter having a recess disposed on the putter head.

None of the above inventions and patents, taken either singularly or in combination, is seen to describe the instant invention as claimed. Thus a golf club for chipping solving the aforementioned problems is desired.

SUMMARY OF THE INVENTION

The golf club according to the invention includes a long shaft fixedly attached to a golf club head. The striking face or surface of which has a configuration which gradually narrows downwardly to a rounded bottom edge of the striking face and forms a leading edge of the striking face when a stroke is initiated. A side view of the club shows it to be generally convex in shape. The leading edge of the striking face is also slightly superior to the turf-contacting surface by about an eighth of an inch. The bottom edge of the striking front surface converges for a short ways downwards to form a relatively convex bottom surface. A side extends rearwardly and upwardly from the bottom surface of the club head to meet the top surface of the golf club extending rearwardly from the front striking surface. The club is fitted with a long shaft which forces the golfer into an upright "eyes over the ball" position which creates a chipping stroke similar to a normal putting stroke.

The convex top surface of the golf club head has a series of parallel grooves incorporated into the top surface thereof and normal to the top edge of the striking surface. These grooves are colored either orange or white to form an optical pattern to help the golfer's eyes focus and to project a more broad-based target line-up so as to make it easier for the golfer to keep the swing line of the club head, on track with the intended path of the ball. These ball centering grooves are designed to assist the golfer in aligning the golf ball with the target and the best striking area of the club head.

Another distinguishing feature of the club is that the front-to-rear surface profile reveals a rounded, convex sole plate mesial to the shaft, making the distal floor plate line angle more angular so as to reduce interference of the club head along the hinge axis at the head of the club. When positioned for play, the angle of the shaft to a line normal to the ground is six to seven degrees. The club integrates or melds certain characteristics of the wood, iron, wedge and putter into a single club.

Accordingly, it is a principal object of the invention to provide a new and improved golf club which allows a golfer to make better chip shots, even when the golfer is not standing on the green.

It is another object of the invention to provide a golf club having ball centering channels or grooves having a plurality of pigment layers thereon to assist the golfer in aligning the golf ball with the target to improve shot accuracy.

Still another object of this invention is to provide a golf club which is suitable for chip shots onto a green to shots of up to 60 yards.

It is a further object of the invention to provide a golf club configured particularly for finesse shots or for providing greater control of the flight of the ball by the golfer.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a golf club for improving a golfer's chip shots, particularly within 60 yards of play to the green G. The preferred embodiments of the present invention are depicted in FIGS. 1–4, and are generally referenced by numerals 5 and 7, respectively.

Figure 1:
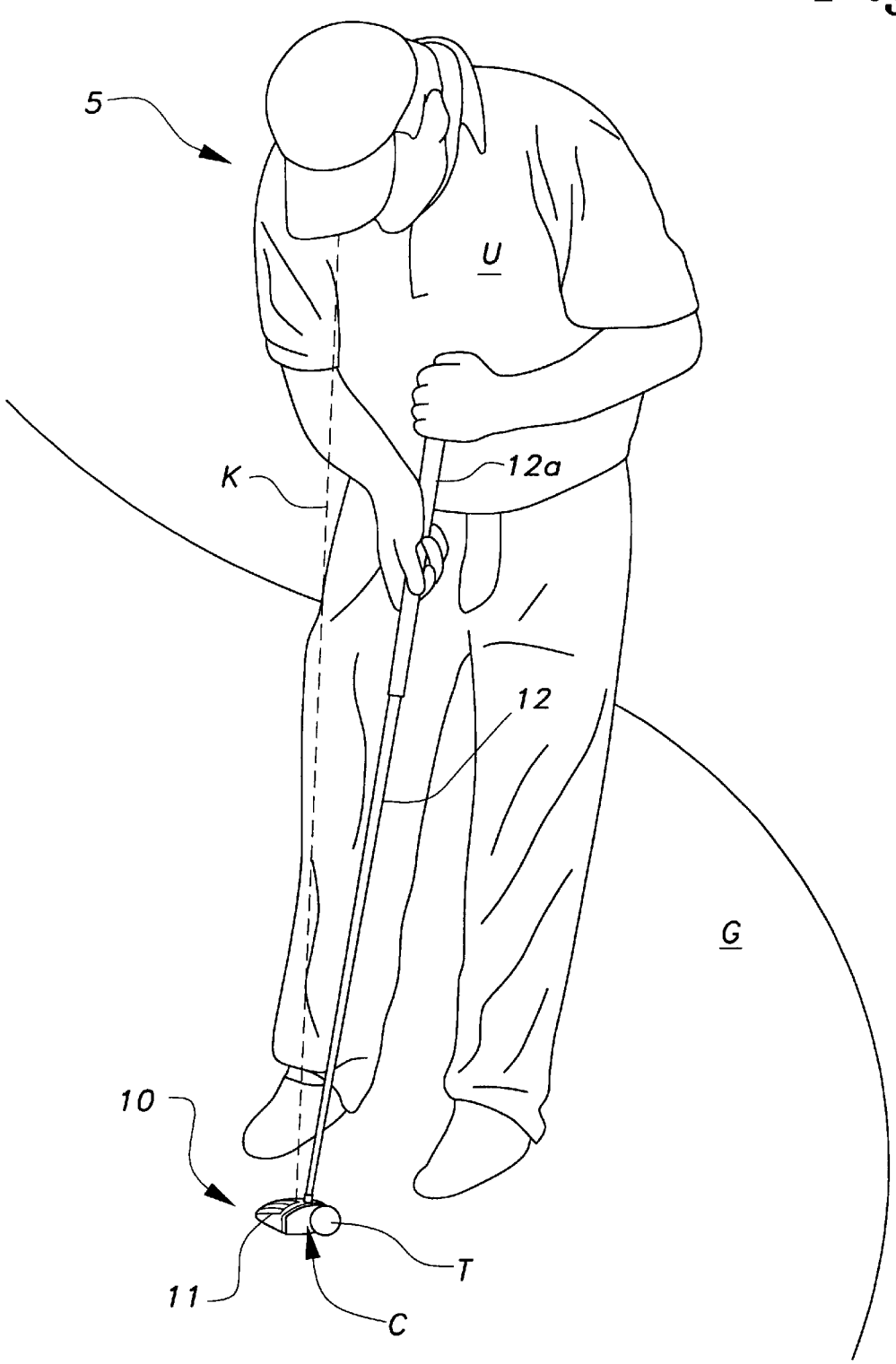
FIG. 1 is an environmental, perspective view of the golf club according to the present invention.

As diagrammatically illustrated in FIG. 1, a golfer U is shown providing a visual line of sight K to colored coded grooves (not shown in color) disposed on and within an alignment surface 11. The alignment surface located on the top surface of the club head 10 serves to assist the user U in projecting a more broad-based target T to a distant location (or "green"). As diagrammatically illustrated in FIG. 2A, the golf club 5 for chip shots comprises a hollow golf club head 10 shaped and formed preferably from a mold 6 diagrammatically illustrated in FIG. 3. As a finished product, the golf club 5 has a substantially planar impact surface 10*a*, a rear portion 10*b*, a sole portion 10*c*, a top alignment surface 11, a heel portion 10*d* and a shaft 12 aligned according to a predetermined critical component angle $\alpha$.

The angle $\alpha$ is preferably about 6 or 7 degrees measured as the shaft's position with respect to a perpendicular line L made square to the ground or green G. The shaft length 1 is selected from a range defined between or by at least 35, 40, 46 and 50 inches, respectively. The golf head 10 is substantially oblong in shape and has an aperture 9 formed substantially within a corner top surface of the club 10 for fastening or fixedly attaching the shaft 12 thereto. A series 15 of grooves 15*a* (first), 15*b* (second), 15*c* (third), 15*d* (fourth), 15*e* (fifth), 15*f* (sixth), and 15*g* (seventh) are formed in parallel with respect to each neighboring or adjacent groove in the series 15 and orthogonal with respect to the impact plate 10*a*. Each groove of the series 15 is formed therein as an arcuate channel which increases in depth from the rear portion 10*b* towards the impact surface 10*a*. The series 15 of substantially arcuate channels or grooves form a color coded optical gauge with channels of differing lengths. As an optical or visual gauge, each groove in the series 15 is color coded via at least one combination laminar and pigment layer for gauging a point of contact C with the target T via the impact surface 10*a*. The gauge is utilized by the golfer as an intermediate step of completing a finesse shot, preferably within sixty yards from the green. With more particularity, each laminar layer includes at least one pigment of color for each groove in the series 15 thereby creating an optical pattern from which a golfer can visualize without unnecessary trial and error a specific point of contact C or impact with the target T via the impact surface 10*a*. This unique feature of the club improves the short game of the golfer.

Figure 2A:
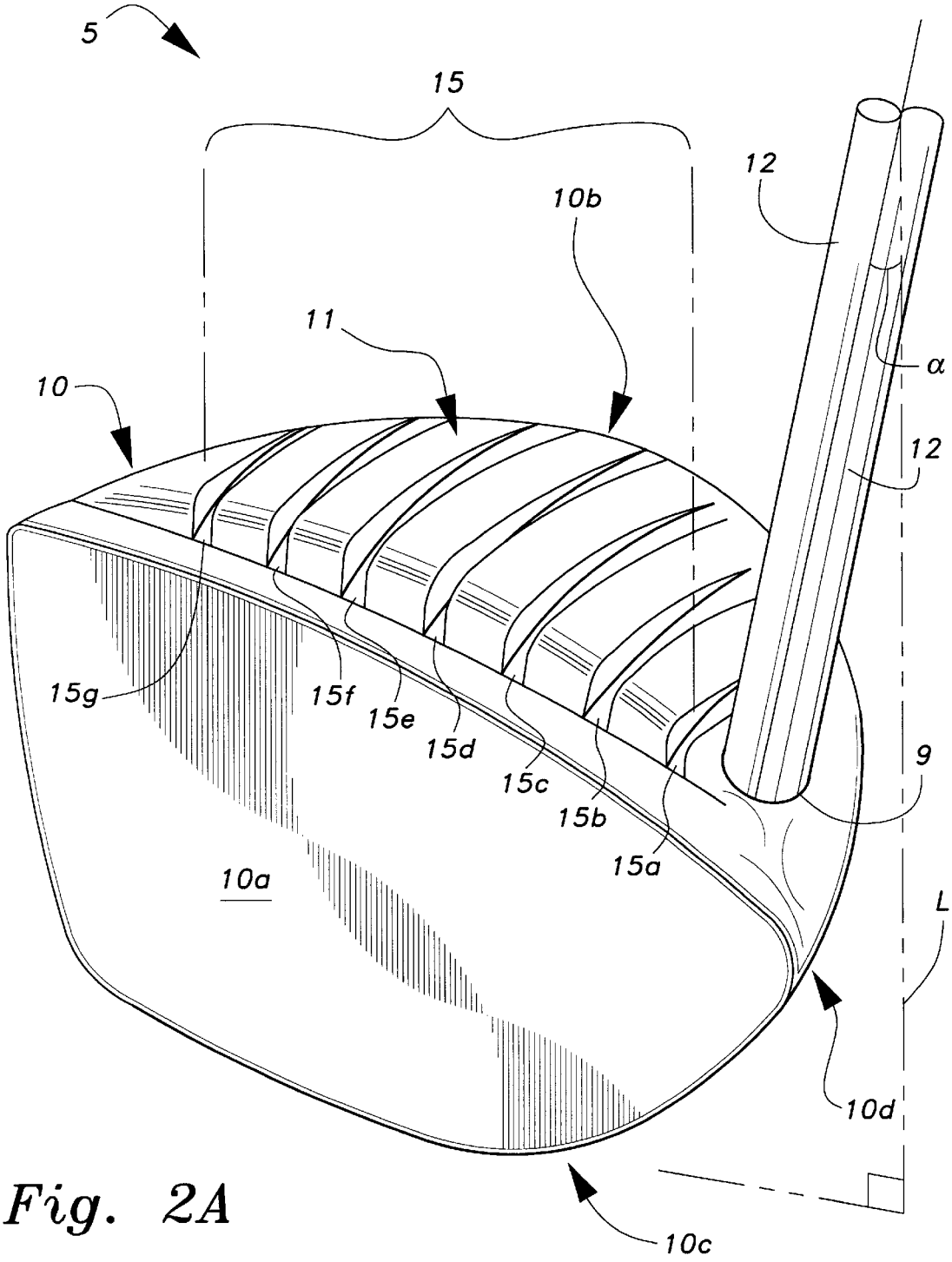
FIG. 2A is a perspective side view of the golf club according to the invention.

As best seen in FIG. 2A, the series 15 preferably comprises seven grooves having at least one laminar layer (not shown in color). As recited above, each laminar layer has at least one pigment therein to form at least one distinct optical pattern for aligning a target therewith to make a particular chip shot. At least one optical pattern of the series 15, beginning at the shaft and radially forward in a direction opposite the heel of the shaft 12 includes wherein the respective first, fourth and seventh groove have at least one laminar layer having a pigment of orange, and the respective second, third, fifth and sixth groove have at least one laminar layer having a pigment of white disposed thereon. Depending on the color perception of a particular user U, the pattern can be customized to fit a unique or special color coded scheme. It has been found that the alternating orange an white pattern is an excellent alignment color code strategy which enables visual alignment of a target T with the impact surface 10*a* for making initiated chip shots without the need for extensive training to do the same.

Figure 2E:
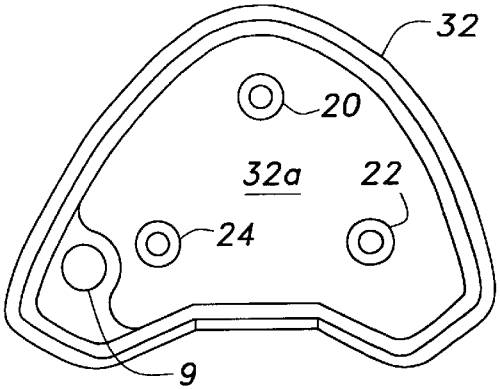
FIG. 2E is a sectional view of FIG. 2D taken along line 2E—2E.
Figure 2F:
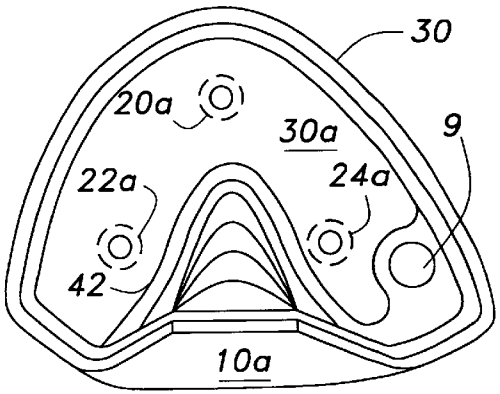
FIG. 2F is a sectional view of FIG. 2D taken along line 2F—2F.
Figure 2C:
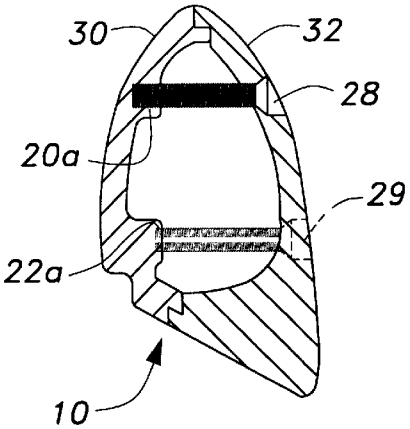
FIG. 2C is a sectional perspective view of FIG. 2 taken along line 2C—2C.

The structure of the golf club head 10 is shown in more detail as diagrammatically illustrated in FIGS. 2B–2F. According to FIG. 2B, a top view of the club head 10 is shown illustrating the plurality of grooves in the series 15 which forms the optical or visual gauge for aligning a target T for impact. Apertures 20, 22 and 24 are shown as subsurface elements in relation to the series of grooves 15. Each aperture 20, 22, and 24 is a fastener insertion point for inserting a fastener to secure a bottom portion 30 of the golf club head 10 to an upper portion 32 formed. Each upper 32 and lower 30 portion is produced by the mold 6 via elements 30' and 32'. FIG. 2C illustrates the use of mechanical fasteners 26 or threaded fasteners for securing the golf club head 10 as a single integrated element via corresponding threaded inserts 20*a*, 22*a*, and 24*a*. Each threaded insert 20*a*, 22*a*, and 24*a* is formed within the bottom portion 30 of the club head. The exposed locations 28 and 29 are finished via conventional filling techniques which are well known in the art. It should be noted, a variety of machining techniques are widely available to one having ordinary skill in the relevant art for providing finish details such threaded apertures, fillings, etc., and thus are not discussed in detail.

Figure 2G:
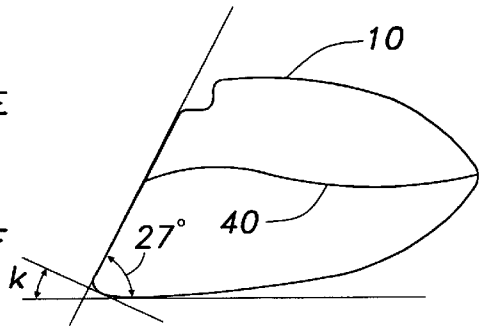
FIG. 2G is a perspective side view of the golf club according to the invention.
Figure 2B:
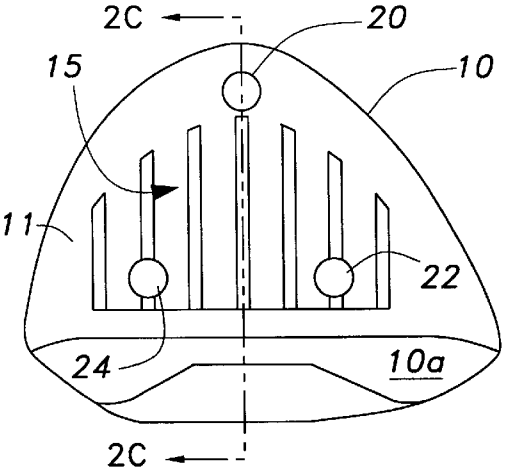
FIG. 2B is a top perspective view of the golf club according to the invention.
Figure 2D:
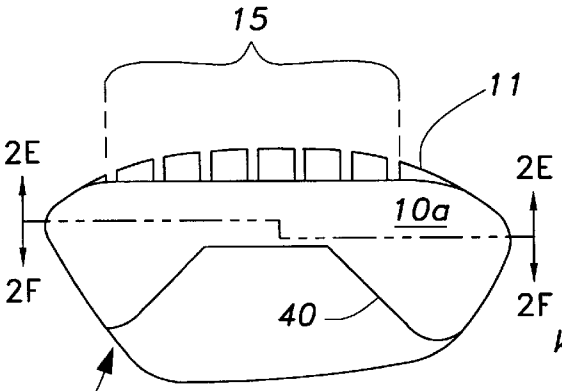
FIG. 2D is a front perspective view of the golf club according to the invention.

As diagrammatically illustrated in FIG. 2D, a front perspective view of the club head 10 is shown illustrating the impact surface 10*a,* and the alignment surface 11 which includes the series of grooves 15 disposed therein. The hollow of the club head 10 features are exposed by taking a sectional cut of the club 10 along lines 2E—2E and 2F—2F. Just below this sectional cut is the linear impression 40 which designates a mating impression produced by the mold 6 and finishing techniques. The upper and lower portions mate substantially along this linear impression to form the integrated impact surface portion 10*a*. FIG. 2E illustrates the interior or hollow portion 32*a* of the upper club portion 32 which is exposed by the sectional cut taken along line 2E—2E.

The sectional cut taken along line 2F—2F exposes the interior portion 30*a* of the bottom portion 30 and is diagrammatically illustrated in FIG. 2F. As shown therein, the club head 10 comprises threaded apertures 20*a*, 22*a*, and 24*a* for threadedly receiving fasteners 26 via respective apertures 20, 22, and 24. A projection ramp 42 or impact reinforcement gradient is also formed therein as a series of interlapping parabolic reinforcement support structures. The is gradient known as "sweet spot" is disposed integral with the interior portion 30*a* and behind the impact surface 10*a*. This particular feature serves to reduce localized stresses at the impact surface by distributing reaction forces throughout parabolic structures of the ramp 42. Accordingly, this feature extends the life and repeated use of the club head without failure due to material of cyclical fatigue.

As diagrammatically illustrated in FIG. 2G, the club head 10 is shown having an appearance of a golf three wood. However, the face of the club 10*a* has at least a preferred 27 degree loft and the sole 10*c* designed with at least a 7 degree bounce angle κ. The sole portion 10*c* is preferably a convex sole portion mesial to the shaft 12. The club head 10 has a size and appearance which resembles the style of a "mallet". The side view of the club 10 as shown in FIG. 2G is convex, front to back, on both the top 11 and bottom 30 surfaces.

Accordingly, the striking or impact surface 10*a* of the golf club head 10 is angled to loft or chip a golf ball while employing a putting stroke. The top centering grooves on the top surface 11 are depicted having a sequence of colors arranged orange-white-white-orange(center groove)-white-white-orange. As recited above, the colors help focus the golfer's eyes and project a more broad-based target line-up, making it easier to keep the swing line of the club head 10 on track. The shaft 12,13 may be included in the mold 6 of the golf ball head 10 or may be placed in a shaft receiving hole 9.

Figure 3:
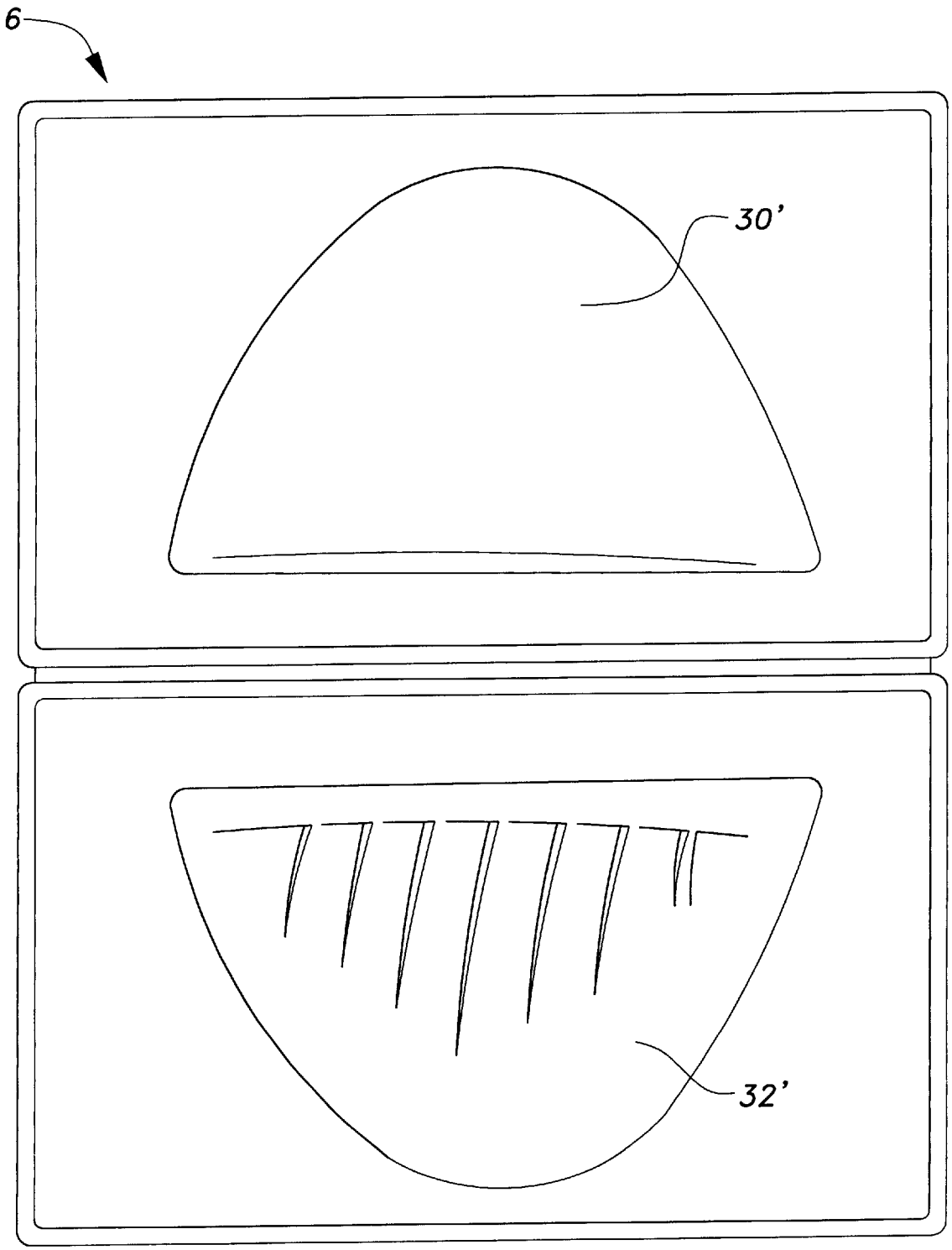
FIG. 3 is a view of the mold for making the golf club according to the invention.
Figure 4:
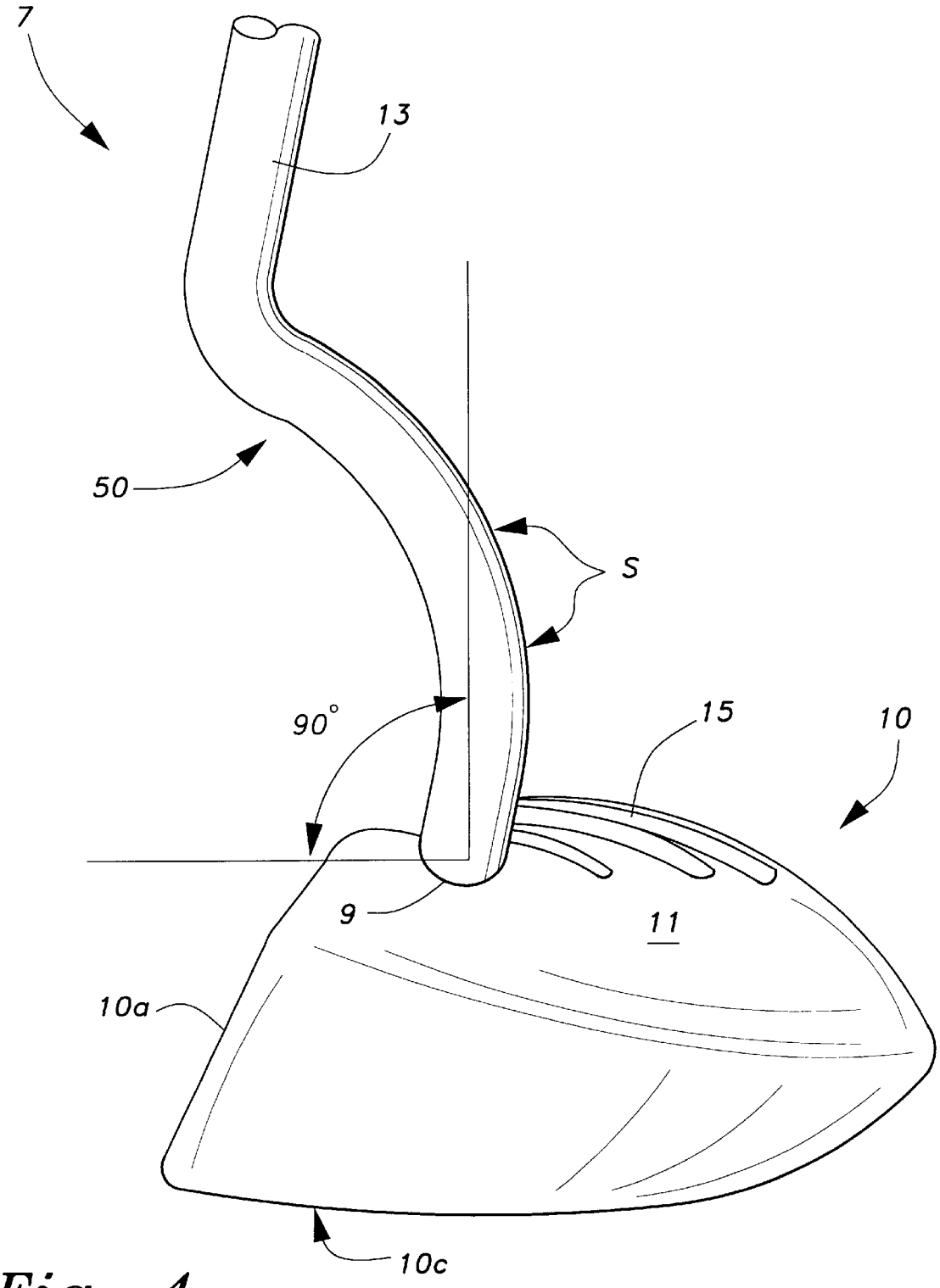
FIG. 4 is a perspective view of the golf club according to a second embodiment of the invention.

FIG. 3 shows the mold 6 for making the golf head according to the invention having negative impression elements 30' and 32'. FIG. 4 is a second embodiment of the invention which utilizes a shaft 13 which works in combination with the club head 10 to balance the moment of inertia of the club 7 about the center of gravity of the club through the swing line. It has been discovered that the shaft 13 which has an inflection point 50 depending on the length 1 and curvature S of the shaft 13 virtually eleminates twisting at the golf club head thereby improving swing comfort for the user. This feature can be customized to accomodated physical and swing characteristics of a particular golfer. This particular customized feature helps to produce measurable and accurate results in the performance of the golfer within sixty yards of play to the green. Accordingly, the mass of the club head 10 is balanced about the centroidal axis of the club 10, thereby providing comfort and minimal twisting at the point of impact around the golf head 10.

The upright, centered position (ref. FIG. 1) at address places a convex, rounded contact to the ground with the leading edge of the striking face 10*a* positioned approximately ⅛ inch superior to the grounded contact area. Another distinguishing feature of the club 10 is that the front-to-back surface profile (illustrated in FIG. 2B) features a rounded, convex sole plate 10*c* mesial to the shaft, hence the distal floor plate line angle is more angular.

This reduces club head interference with the hinge axis at the head of the club through the swing. With respect to weight characteristics, the club head 10 is hollow and made of two piece machined construction thereby reducing material cost factors. The top portion 11 is made preferably from aluminum and the bottom portion 30 from stainless steel. This arrangement "weights" the bottom 30 or sole 10*c* of the club head 10 and produces a lower center of gravity. The lower center of gravity is enhanced by the additional stainless steel ramp 42 which is known as the "sweet spot" of the club's impact surface 10*a*. The ramp 42 defines the "sweet spot" and provides a more solid ball or target contact therewith. The club head 10 is designed so that the shaft 12,13 is inserted into the hole 9 thus eliminating the conventional hosel and accompanying "shanked" shots. The top, surface design, of the club head 10 integrates a surface design consisting of seven longitudinal lines parallel to the target T line and perpendicular to the plane of contact, which aids in the user's U line of sight alignment. The haft 12,13 is attached at a lie angle of approximately 79 degrees for a shaft of 46 inches and over. The "lie angle" positions the golf club head 10 in the golfer's putter-stance position.

Other advantages of the golf club 5,7 according to the invention includes wherein each respective shaft 12, 13 further includes a handle portion comprising a moisture absorbing gripping surface 12*a* and 13*a* (not shown), respectively. The effective results of the club head 10 according to the invention are (1) an improved line of sight accuracy coefficient; (2) an improved chipping effect to produce lofted shots with the ability to carry (in the air) over short distances of "off the green"; (3) an improved confidence "off the green" due to the ease of the pendulum swing or the putting style to produce an effective inertia transfer to the ball; (4) the elimination or reduction of miss-hits (shanks, toe-shots, fat shots, etc.) resulting in tighter ball patterns of shots nearer the hole; and (5) an improvement in the number of "up-and-down" par saves from "off the green" to effectively lower a golfer's ultimate score.

It is to be understood that the present invention is not limited to the embodiments described above, but encompasses any and all embodiments within the scope of the following claims.

I claim:

1. A golf club for performing chip shots comprising:

a hollow golf club head having a substantially planar impact surface, a rear portion, a sole portion, a top alignment surface, a heel portion and a shaft aligned according to a predetermined critical component angle and shaft length, said head is substantially oblong in shape;

said top alignment surface comprising an aperture disposed therein for fastening the shaft thereto and having a series of grooves formed parallel with respect to each adjacent groove in the series and formed orthogonal with said impact surface, wherein said grooves increase in depth from the rear portion towards the impact surface to form a series of substantially arcuate channels therein;

the series of grooves further include at least one laminar layer having at least one pigment of color for each groove in the series to create an optical pattern thereon with respect to each groove in the series for effecting user guided club head to target alignment for chipping.

2. The golf club for chipping according to claim 1, wherein said series comprises seven grooves having said at least one laminar layer having said at least one pigment therein to form at least one distinct optical pattern for aligning chip shots.

3. The golf club for chipping according to claim 2, wherein said at least one optical pattern of the series formed by a laminar layer having at least one pigment of color in each groove comprises beginning at the shaft and radially forward opposite the heel of the shaft, said pattern being for a first, fourth and seventh groove at least one laminar layer having a pigment of orange and for a second, third, fifth and sixth grove at least one laminar layer having a pigment of disposed thereon.

4. The golf club for chipping according to claim 1, wherein said sole portion is a convex sole portion mesial to the shaft.

5. The golf club for chipping according to claim 1, wherein said critical component angle is about 7 degrees.

6. The golf club for chipping according to claim 1, wherein said critical component length is at least one of 35, 40, 46 and 50 inches.

7. The golf club for chipping according to claim 1, wherein shaft further includes a handle portion comprises a moisture absorbing gripping surface.

* * * * *